US011499265B2

(12) United States Patent
Haxby et al.

(10) Patent No.: US 11,499,265 B2
(45) Date of Patent: Nov. 15, 2022

(54) POLYMER-COATED FABRIC

(71) Applicant: TRELLEBORG NOTTINGHAM LIMITED, Nottingham (GB)

(72) Inventors: Richard Haxby, Nottingham (GB); Ilias Alexandrakis, Nottingham (GB)

(73) Assignee: TRELLEBORG NOTTINGHAM LIMITED, Nottingham (GB)

( * ) Notice: Subject to any disclaimer, the term of this patent is extended or adjusted under 35 U.S.C. 154(b) by 418 days.

(21) Appl. No.: 16/459,019

(22) Filed: Jul. 1, 2019

(65) Prior Publication Data

US 2020/0002884 A1 Jan. 2, 2020

(30) Foreign Application Priority Data

Jun. 29, 2018 (GB) ..... 1810700

(51) Int. Cl.

| | |
|---|---|
| ***B05D 1/42*** | (2006.01) |
| ***D06M 15/564*** | (2006.01) |
| ***D06M 15/263*** | (2006.01) |
| ***D06M 15/507*** | (2006.01) |
| ***D06M 15/643*** | (2006.01) |
| ***D06M 17/10*** | (2006.01) |
| ***B05D 1/34*** | (2006.01) |

(Continued)

(52) U.S. Cl.

CPC ..... *D06M 15/564* (2013.01); *B05D 1/34* (2013.01); *B05D 1/42* (2013.01); *D06M 15/263* (2013.01); *D06M 15/507* (2013.01); *D06M 15/643* (2013.01); *D06M 17/10* (2013.01); *B05D 2201/02* (2013.01); *B05D 2203/00* (2013.01); *B05D 2401/20* (2013.01); *B05D 2401/30* (2013.01); *B05D 2503/00* (2013.01); *D06M 2101/02* (2013.01); *D06M 2101/32* (2013.01); *D06M 2101/34* (2013.01); *D06M 2200/12* (2013.01); *D06M 2200/30* (2013.01)

(58) Field of Classification Search

CPC ..... B05D 1/34; B05D 1/42; B05D 2203/00; B05D 2401/20; B05D 2401/30

See application file for complete search history.

(56) References Cited

U.S. PATENT DOCUMENTS

| | | | | |
|---|---|---|---|---|
| 2003/0176560 A1* | 9/2003 | Mueller | C08K 7/00 | 524/494 |
| 2003/0176613 A1* | 9/2003 | Hohberg | D06N 3/12 | 428/378 |
| 2011/0290727 A1* | 12/2011 | Van Engelen | B01D 69/125 | 429/491 |

FOREIGN PATENT DOCUMENTS

| | | |
|---|---|---|
| CN | 106091818 A | 11/2019 |
| DE | 127408 A1 | 9/1977 |

(Continued)

OTHER PUBLICATIONS

Sayed, What Is Textile: Definition And Meaning, 2018, Textile Apex. (Year: 2018).*

(Continued)

*Primary Examiner* — Hai Y Zhang

(74) *Attorney, Agent, or Firm* — Troutman Pepper Hamilton Sanders LLP (Rochester)

(57) ABSTRACT

Waterproof composite fabrics comprising a textile layer and a continuous polymer layer that comprises adjoining first and second regions with different physical or visual properties, and knife-over-roll coating methods for 5 manufacturing said composite fabrics. The waterproof composite fabrics described are particularly suitable for covering medical support surfaces, for instance mattresses.

8 Claims, 4 Drawing Sheets

(51) Int. Cl.

| | |
|---|---|
| *D06M 101/02* | (2006.01) |
| *D06M 101/32* | (2006.01) |
| *D06M 101/34* | (2006.01) |

(56) References Cited

FOREIGN PATENT DOCUMENTS

| | | | | |
|---|---|---|---|---|
| EP | 1424451 | A1 | | 10/2002 |
| GB | 1073920 | | * | 6/1967 |
| GB | 1438617 | | | 5/1973 |
| GB | 1491042 | | | 10/1974 |
| GB | 1438617 | | * | 6/1976 |
| WO | 2015/153979 | A1 | | 10/2015 |

OTHER PUBLICATIONS

Great Britain Search Report for GB1810700.3 (dated Nov. 5, 2018).
Trixielixie.co.uk, Product Description, Made by Rae—Washi Dress, https:www.trixielixie.co.uk/made-by-rae—washi-dress-3428-p.asp (accessed Oct. 26, 2018).

* cited by examiner

POLYMER-COATED FABRIC

This application claims the priority benefit under 35 U.S.C. § 119 of United Kingdom Application No. 1810700.3, filed 29 Jun. 2018.

FIELD OF THE INVENTION

This invention relates to polymer-coated textiles and methods for their production.

BACKGROUND OF THE INVENTION

A polymer-coated textile is a composite fabric formed of a textile substrate coated with one or more thin layers of a polymeric material. The overall physical properties of the composite fabric are determined both by the nature of the textile and the polymeric material, and the weight and number of the layers of polymeric material. The properties of a polymer-coated textile can therefore be designed to suit a particular application by altering these variables.

Coated textiles, and particularly polymer-coated textiles, are used in many applications in a range of industries. Due to the polymeric surface, they are typically waterproof or water or moisture resistant, windproof and/or easy to clean. Useful applications include outdoor equipment such as tent canvas, outdoor apparel and protective clothing, as well as applications where hygiene is important such as mattress covers, seat covers and upholstery. The hygienic nature and ease of cleaning of polymer-coated textiles gives them particular utility in the healthcare sector.

Of particular interest to the applicant are polymer-coated textiles for covering medical support surfaces. As used in the art, the term "medical support surface" means a surface that is used in a medical setting to support a patient. Particular examples include mattresses or mattress overlays, hospital trolleys, stretchers, operating tables, ambulance support devices, seating such as bedside seating, specialist seating, wheelchair seating and recliners or recliner overlays, and slings and hoists. For instance, polymer-coated textiles are used to make hospital bed mattress covers. The cover may be integral to the medical support surface or provided as a removeable cover.

To be suitable for covering a medical support surface, the polymer-coated textile must be waterproof and to at least some extent stretchy (to provide pressure redistribution) and breathable with a soft patient-contacting surface. To achieve this the textile must have the appropriate mechanical properties and the polymer-coating must be thin, typically with a coating weight of less than 220 gsm, such that it will not adversely impede the mechanical properties of the fabric. Also, the method by which the polymer coating is applied will affect its penetration into the textile and therefore the extent to which it modifies its mechanical properties, for example its ability to stretch.

Knife-over-roll coating is a method for applying a liquid coating to the surface of a substrate which is well established in the art, and commonly used in both transfer-coating and direct-coating. In knife-over-roll coating of a polymer onto a textile, the polymer is typically dissolved in one or more solvents or heated to achieve the required flow. The polymer composition is applied to the substrate, which subsequently passes through a narrow gap between a knife or blade and a support roller. As the coated substrate passes through the gap, excess polymer composition is scraped off the substrate by the knife, leaving a coating of the desired thickness on the surface of the substrate. The size of the gap between the support roller and the substrate is proportional to the desired weight of the polymer layer. The knife may be perpendicular to the support roller or may form an angle of between 45° and 90° with the support roller.

In transfer-coating, the polymer coating is formed on a carrier and then transferred from the carrier to the textile. The carrier may be a release paper or a polymeric release liner or the like. The polymeric layer may be dried on the carrier prior to application of the textile (dry lamination) or the process may be carried out while the polymer is still liquid (wet lamination). In direct-coating, the coating is applied directly to the textile substrate.

Traditional knife-over-roll methods of both transfer- and direct-coating polymer onto fabric result in the production of a fabric having a continuous polymer layer and uniform physical characteristics across its surface. However, for some applications it would be preferable to use a polymer-coated fabric having regions with different physical or visual characteristics. To achieve this, it is currently necessary to sew or bond multiple fabrics together or to overlap layers of different polymer compositions. For instance, a continuous coating of a single polymer composition may be overlaid or embossed with a partial coating (eg a single section, stripes or a patterned design) of one or more different polymer compositions having different physical or visual characteristics.

It is often desirable for medical support surface covers to have regions that differ in their physical or visual characteristics. For example, it is essential that waterproof mattress covers for use in hospitals are durable as they undergo heavy use, but the properties of a fabric which render it durable typically also reduce breathability, which is essential for a patient's comfort. Ideally, the mattress cover would be durable at the sides where the wear is the heaviest, but breathable in the middle where the patient lies. To achieve this using current polymer-coated fabrics, two fabrics having the required properties may be sewn together. Unfortunately, that results in a seam line which affects the stretch properties of the cover, can be a source of irritation or injury to a patient and is a risk point for liquid ingress and/or bacterial contamination. Alternatively, a polymer-coated fabric with regions that differ in their physical or visual characteristics may be achieved by overlapping layers of different polymer compositions. To make a mattress cover, for example, a thin continuous layer of one polymer, providing the stretchy, breathable centre of a mattress cover, may be coated with another polymer in longitudinal stripes along the length of the fabric to reinforce the sides of the mattress cover. However, that would inevitably result in a ridge at the edge of the overlaid polymer which, much like a seam, could be a source of irritation or injury to the patient. Moreover, the regions of overlap, comprising two or more layers of different polymer compositions are necessarily thicker, reducing both stretch and breathability of the fabric in those regions.

SUMMARY OF THE INVENTION

There has thus been devised the following invention which overcomes or substantially mitigates the aforementioned and other problems associated with the prior art.

According to a first aspect of the invention there is provided a waterproof composite fabric comprising a textile layer and a continuous polymer layer, the polymer layer comprising adjoining first and second regions that have different physical or visual properties, the first and second regions being in a side-by-side arrangement extending longitudinally along a length of the fabric, the first region being formed from a first polymer composition and the second region being formed from a second polymer composition.

By "waterproof" is meant that, as long as the polymeric coating remains intact, it provides a complete barrier to liquid penetration.

By "side-by-side" arrangement is meant that the first and second regions meet and join side-by-side in the plane of the substrate, in other words the interface between the first and second regions (ie line of contact) is along their longitudinal length. The polymer layer comprising first and second regions that have different physical or visual properties is a single layer. Thus, the continuous polymer layer comprising first and second adjoining regions is of substantially uniform thickness. The surface of the continuous polymer layer in the region of the interface between the two regions is flat. While there will be a small degree of merging or mingling of the first and second compositions at their interface, the first and second regions do not overlap. Thus, the top surface of the polymer layer (which is the top surface of the composite fabric) is flat and smooth, without ridges or steps.

The composite fabric of the invention is a polymer-coated fabric having adjoining regions which have different physical or visual characteristics, without the need for subsequent manufacturing or the introduction of a seam line. It is thus advantageous for use in manufacturing hygienic mattress covers or other medical support surface covers, where it is desirable to have regions with different physical properties but where the presence of a seam is undesirable. The presence of multiple regions having different physical characteristics within a single sheet of fabric removes the additional manufacturing steps associated with cutting and sewing multiple pieces of fabric together, thus reducing costs.

Thus, there is provided a medical support surface cover comprising a waterproof composite fabric that comprises a textile layer and a continuous polymer layer, the polymer layer comprising adjoining first and second regions that have different physical or visual properties, the first and second regions being in a side-by-side arrangement extending longitudinally along a length of the fabric, the first region being formed from a first polymer composition and the second region being formed from a second polymer composition.

The medical support surface cover may be a mattress cover.

The textile layer may be formed from a sheet of textile fabric. A wide range of different types of textile fabric are known in the art, and any suitable textile fabric may form the textile layer of the present invention. The textile layer may be a woven, knitted or non-woven textile fabric, and may be formed of natural or synthetic fibres. The structure of a textile fabric and its fibre content give rise to the specific physical properties of the textile fabric, for example tensile strength, flexibility, stretch etc. The selection of the textile fabric may therefore be made based on the desired properties of the composite fabric.

The textile layer may be a knitted fabric, for example a weft-knitted fabric or a warp-knitted fabric. The structure of a knitted fabric typically results in the fabric displaying some stretch and recoil properties, and a knitted fabric may therefore be particularly appropriate where it is desirable for the final product to exhibit some stretch or elasticity. Knitted textiles are stretchy because of the degrees of freedom in the loops within the structure. The textile fabric may alternatively be a woven fabric, or a non-woven fabric. All textiles may be extensible if they are manufactured using a yarn or fibre that is inherently extensible. This may be due to the polymeric nature of the yarn, for instance if it contains elastane, or because the yarn has been texturised.

For the composite fabric to provide pressure redistribution and therefore be used as a medical support surface cover, the composite fabric will preferably have an extensibility greater than about 10% in both the warp and weft direction (measured using EN ISO 1421).

The textile fabric may be formed of natural or synthetic fibres, including but not limited to polyester, polyamide, modified acrylics and cotton. The textile fabric may be formed of nylon. The textile fabric may be a flame-retardant fabric, and may be intrinsically flame-retardant, or may have been treated such that it is flame-retardant.

The composite fabric comprises a continuous polymer layer. Thus, the polymer layer is a complete layer extending with an unbroken surface across the composite fabric. Where the first and second regions join, the join is not characterised by any break or gap in the polymer layer.

The continuous polymer layer with adjoining first and second regions that have different physical or visual properties, which first and second regions are in a side-by-side arrangement extending longitudinally along a length of the fabric and which are formed from first and second polymer compositions, may be the only polymer layer in the composite fabric. Alternatively, the composite fabric may comprise additional polymer layers, preferably additional continuous polymer layers, which layers are each formed from a single polymer composition. The one or more additional polymer layers may be positioned in between the textile layer and the polymer layer comprising adjoining first and second regions, and/or on top of the polymer layer comprising first and second regions. Thus, the continuous polymer layer may be a laminate. In some preferred embodiments, the composite fabric comprises one or more polymer layers termed "interlayers" in between the textile layer and the polymer layer comprising first and second regions. The one or more interlayers may be layers of polymer adhesive. In some embodiments, the composite fabric may comprise a textile layer, an adhesive layer, a further interlayer and a continuous polymer layer comprising adjoining first and second regions that have different physical or visual properties, the first and second regions being in a side-by-side arrangement extending longitudinally along a length of the fabric, the first region being formed from a first polymer composition and the second region being formed from a second polymer composition.

By the "thickness" of the polymer layer we refer, unless otherwise stated, to the thickness of the continuous polymer layer comprising side-by-side first and second regions plus any other polymer layers to which it is laminated, and, depending on the context, to the depth of the total polymeric coating applied or to the thickness of the total dried and/or cured polymeric coating measured above the substrate after the polymeric coating has dried and/or cured.

Minor variations in the weight of the polymer layer across the surface of the fabric may occur as a result of the manufacturing process. Thus, by "thickness" we generally refer to the mean thickness of the polymer calculated over at least 80% of the coated textile. By "substantially uniform thickness" is meant that there is minimal variation in the thickness of the polymer coating. Typically, the variation in the thickness of the polymer coating is less than 10% of the mean thickness of the polymer, or less than 5%, or less than 2%, where the mean thickness is calculated over at least 80% of the coated textile.

The polymeric coating may be less than about 300 microns thick. In some embodiments the polymeric coating may be less than about 200 microns thick, less than about 150 microns thick or less than about 100 microns thick. In some embodiments the polymeric coating may be more than about 30 microns thick, more than about 50 microns thick or more than about 70 microns thick. In some embodiments, the polymeric coating may be between about 30 and 300 microns thick, between about 50 and 200 microns thick or between about 70 and 150 microns thick. In some embodiments the polymeric coating may be between about 70 and 100 microns thick.

A surface coating is typically measured by weight, that is, the weight of coating which covers a particular area. All weights below are given in gsm (ie grams per square metre, or $g/m^2$). The weight of the polymer layer may be greater than 5 gsm, or greater than 10 gsm, or greater than 20 gsm, or greater than 25 gsm. The weight of the polymer layer may be less than 300 gsm, or less than 220 gsm, or less than 210 gsm, or less than 200 gsm, or less than 150 gsm or less than 100 gsm or less than 50 gsm, or less than 40 gsm. Thus, the weight of the polymer layer may be between 5 gsm and 220 gsm, or between 20 gsm and 200 gsm.

Due to slight variations in weight which may occur as a result of the manufacturing process, the weight of the polymer layer may alternatively be described as a mean average weight. Thus, the mean average weight of the polymer layer may be between 5 gsm and 220 gsm, or between 20 gsm and 200 gsm. For example, the mean average weight of the polymer layer may be 75 gsm, or 80 gsm, or 85 gsm, or 90 gsm, or 95 gsm, with the weight variation being ±10% or ±5%, or ±2% of the weight of the polymer layer.

By "substantially uniform weight" is meant that there is minimal variation in the weight of the polymer layer. Typically, the variation in the weight of the polymer is less than 10% of the weight of the polymer, or less than 5%, or less than 2%.

It has been found that a polymer layer having a thickness or weight as described above is of sufficient depth to provide continuous coverage of the polymer layer across the composite fabric, whilst being thin enough that it does not impede the physical properties of the textile fabric, eg that at least a proportion of the stretch and recoil properties of the textile layer are retained in the composite fabric.

Generally, the thinner the polymeric coating, the higher the moisture vapour transmission rate (MVTR). MVTR defines the ability of the polymer-coated fabric to transmit water vapour above a specified level whilst maintaining a high degree of resistant to water penetration. In some embodiments of the invention, the composite fabric may have an MVTR of greater than about 150 $g/m^2/24$ hours (measured in accordance with ASTM D1653).

The continuous polymer layer and the textile layer may form opposing surfaces or exterior faces of the composite fabric. Alternatively, additional layers may be applied over either or both of the textile and continuous polymer layers.

The first and second regions may be joined together by adhesion of the first and second polymer compositions to each other and/or the underlying substrate, or through a small degree of merging or mingling of the first and second compositions along their line of contact.

Typically, the first and second regions are formed simultaneously. Both direct-coating and transfer-coating require the application of a liquid polymer composition to a substrate. In the manufacture of the composite fabric of the invention, the first and second polymer compositions may be applied to the substrate simultaneously by direct coating or transfer coating. Simultaneous application of the first and second compositions allow the first and second polymer compositions to key together (ie mingle or merge) at the join to form a single, continuous polymer layer across the composite fabric. The continuity of the polymer layer is not compromised. Equally, the join does not stand out in relief or otherwise form a ridge: the polymer layer having first and second regions is of substantially uniform thickness.

The first and second regions of the polymer layer are adjacent, and are typically parallel, to one another. It will be appreciated that the polymer layer may comprise additional regions, for example third and fourth, or more, regions. Where additional regions are present, they will typically run parallel to the first and second regions, such that the composite fabric comprises a series of parallel longitudinal regions running along the length of the fabric.

The first and second regions of the polymer layer may be of substantially the same width as each other, or they may be of different widths. The width of the first and second regions may be greater than 1 cm. The width of the first and second regions may be greater than 10 cm.

The first and second regions of the polymer layer have different physical or visual properties. Thus, the first and second regions differ in at least one physical or visual property or characteristic.

Physical or visual properties or characteristics include any characteristic or property of the region which affects the visual, functional or mechanical properties of the region. Physical and visual properties include, but are not limited to, colour, physical durability (eg measured using ISO1419 followed by BS3424-26), chemical durability, coefficient of friction, porosity, moisture vapour transmission rate, water vapour transmission rate, strength, stiffness, opacity, density, flame retardancy, electrical conductivity and thermal conductivity. Thus, the first composition may be more or less durable than the second polymer composition or may have a higher or lower coefficient of friction.

The first and second regions may particularly differ in at least one physical property, that is, one property which affects the functional or mechanical properties of the region. For example, the first and second regions may differ in at least one of the following: physical durability (eg measured using ISO1419 followed by BS3424-26), chemical durability, coefficient of friction, porosity, moisture vapour transmission rate, water vapour transmission rate, strength, stiffness, density, electrical conductivity and thermal conductivity.

Where additional regions (eg third and fourth regions) are present, each of the additional regions may have the same physical and visual properties as either of the first or second regions, or may have different physical and/or visual properties. Thus, the composite fabric may comprise multiple regions having the same physical and visual properties, providing that adjoining first and second regions differ in at least one physical or visual property.

The first and second regions extend longitudinally along a length of the composite fabric, and are typically parallel to each other. Where there are additional regions, eg third and fourth regions, the additional regions may also extend longitudinally along a length of the composite fabric, and may run parallel with the first and second regions. Thus, the first and second (and any additional) regions extend lengthwise along the fabric, that is, extend along the fabric in the direction of the longest dimension.

The first region is formed from a first polymer composition and the second region is formed from a second polymer composition. The polymer compositions used to form the first and second regions comprise at least one polymer, but may also comprise additional additives.

The polymer(s) comprised within the first and second polymer compositions may be the same, or may be different, providing that the resulting first and second regions differ in at least one physical and/or visual property. It will be appreciated that the different physical and/or visual properties may be achieved in a number of ways, for instance by altering the chemical composition, eg the choice of polymer or additives, or via the method used to prepare the polymer composition.

The polymer(s) used in the polymer compositions may be any suitable polymer that can be applied to a substrate, and such polymers are known in the art. Particular polymers suitable for use in the present invention include polyurethanes, acrylics, polyesters and silicones. Thermoplastic polymers may be used for the polymeric coating, an advantage being that they are weldable and therefore afford sealed waterproof seams with high seam strength.

The polymer may be a polyurethane polymer or a silicone-based polymer.

In certain embodiments, the polymer is not a polyvinyl chloride (PVC)-based polymer and/or does not contain PVC.

The inclusion of additives in a polymer composition may also be used to influence the physical and/or visual characteristics of the region formed from that polymer composition. Additives which may be incorporated include, but are not limited to, stability agents/modifiers, antimicrobials and pigments. For example, pigments may be included in the polymer composition to alter the colour of the final region.

The monomers used in the manufacture of a polymer will influence the final properties of that polymer, and hence of a region formed from a polymer composition comprising that polymer. Blending of multiple polymers in a polymer composition may also be used to influence the physical and/or visual characteristics of the region formed from that polymer composition.

Typically, the composite fabric of the invention is manufactured by applying the polymer compositions in liquid form to a textile or carrier. Once dried, they form the first and second regions present in the polymer layer of the composite fabric of the invention.

The polymer may be heated and applied as a melt. In knife-over-roll coating, the polymer composition is in direct contact with an area of the substrate that is above the support roller, and can be spread by the knife to provide a thin coating, even at relatively high viscosities. Therefore, suitable temperatures for knife-over-roll coating using heated polymer compositions may be equal to or slightly higher than the melting temperature of the polymer composition (eg the highest melting temperature of the polymer or highest melting temperature where there is a mixture of polymers). In some embodiments, the polymer composition may be heated to a temperature below about 100° C., below about 90° C., or below about 80° C. The polymer composition may be heated to a temperature between about 60-100° C., 65-90° C. or 70-80° C.

Alternatively, the polymer may be dissolved in solvent, which is removed when the polymer is dried and/or cured.

The solvent may be one solvent or a mixture of solvents (sometimes termed a solvent package or system). Examples of suitable solvents include solvents selected from the group consisting of N-methylpyrrolidone (NMP), dimethylformamide (DMF), acetone, methyl ethyl ketone (MEK), propan-2-ol (isopropyl alcohol or IPA), toluene, ethyl acetate, tetrahydro furan (THF) and mixtures thereof. The solvent may be DMF, MEK, toluene, or any mixture thereof. The solvent may be a mixture of DMF, MEK and toluene.

It may be advantageous to use the same solvent or solvent system to dissolve the first and second polymer compositions. Without wishing to be bound by theory, it is thought that use of the same solvent or solvent package improves the mingling/merging of the different polymer compositions at the join (ie their interface).

When the polymer composition is dried into a polymeric material, the polymer(s) and any additives may remain in the same structural form(s) as they held in the liquid composition, or may interact during the drying or curing process, for example through cross-linking. Therefore, the final structure of the polymeric material and/or the compounds contained therein in the first and second (and any additional) regions of the finished composite fabric may differ from the structure of the polymer(s) and additives in the polymer compositions from which the first and second (and any additional) regions are formed.

Thus, according to a further aspect of the invention, there is provided a waterproof composite fabric comprising a textile layer and a continuous polymer layer, the polymer layer comprising adjoining first and second regions that have different physical or visual properties, the first and second regions being in a side-by-side arrangement extending longitudinally along a length of the fabric, the first region comprising a first polymeric material and the second region comprising a second polymeric material.

The composite fabric of the invention may comprise one or more additional layers, either disposed between the polymer layer and textile layer, or on the outer surface of either the polymer or textile layer. The one or more additional layers may be continuous layers. The one or more additional layers may completely cover the surface of the polymer layer or textile layer to which they are applied.

The composite fabric of the invention may comprise an interlayer disposed between the textile layer and the continuous polymer layer. The interlayer is typically a polymeric layer, and may be formed from a third polymer composition which extends across the length and width of the fabric. The third polymer composition from which the interlayer is formed may be the same as either the first or second polymer composition from which the continuous polymer layer is formed, or may be different.

Alternatively, the interlayer may have a similar structure to the continuous polymer layer, and comprise adjoining third and fourth regions that have different physical or visual properties, and which extend longitudinally along a length of the fabric, the third region being formed from a third polymer composition and the fourth region being formed from a fourth polymer composition. The third and fourth polymer compositions may be the same as the first and second polymer compositions respectively, or may be different.

An interlayer may be used to help in achieving particular properties which are desirable in the final composite fabric. For example a durable interlayer may be used to increase the durability of the finished fabric. It is thus the combination and interaction of the properties of the continuous polymer layer, interlayer (where present) and textile layer which determine the final properties of the composite fabric.

The interlayer may also be used to improve adhesion between the textile and continuous polymer layers, and may thus be an adhesive layer (eg a polymeric adhesive), and/or may help improve the quality of the fabric by reducing the impact of small flaws which may occur during application of the continuous polymer layer.

Where present, the interlayer is typically lighter than the continuous polymer layer comprising adjoining first and second regions, but may have the same weight or a greater weight. The interlayer may have a weight of between about 5 gsm and about 200 gsm, or between about 5 gsm and about 100 gsm, or between about 5 gsm and about 50 gsm, or between about 5 gsm and about 30 gsm, eg the interlayer may have a weight of about 10, or 15, or 20, or 25, or 30, or 35, or 40 gsm.

The interlayer may be of a substantially uniform thickness, meaning that there is minimal variation in the thickness of the interlayer. Typically, the weight variation of the interlayer is less than 10%, or less than 5%, or less than 2%.

The interlayer may be a polymeric layer, formed from a third (and, optionally, fourth) polymer composition. The third (and, where present, fourth) polymer composition which forms the interlayer comprises at least one polymer, and the composition may be determined depending on the final properties desired. The polymer used in the third (and, where present, fourth) polymer composition may be any suitable polymer that can be roller-coated, and such polymers are known in the art. Particular types of polymers suitable for use in the present invention include polyurethanes, acrylics, polyesters and silicones.

The polymer present in the polymer composition(s) which form the interlayer may the same as the polymer present in the polymer compositions which form either or both of the first and second regions. Thus, the interlayer, first and second regions may all be formed from polymer compositions which comprise the same polymer, eg polyurethane. Alternatively, different polymers may be used in some or all of the different polymer compositions.

The polymer composition(s) that form the interlayer may be dissolved in a solvent or solvent system. The solvent or solvent system that is used may be the same solvent or solvent system that is used to dissolve the first and/or second polymer compositions.

The composite fabric of the invention may comprise one or more layers of adhesive, in addition to the interlayer. A layer of adhesive may be present between the textile layer and its overlying polymer layer (either the continuous polymer layer or an interlayer), aiding adhesion of the textile layer to the overlying polymer. There may alternatively or additionally be a layer of adhesive between the interlayer and continuous polymer layer.

Suitable adhesives are known in the art, and should be selected to be compatible with the polymers into which it will come into contact. For example, where the interlayer comprises polyurethane, a layer of polyurethane adhesive may be present between the textile layer and interlayer to aid bonding of the two layers.

It has been surprisingly found that the composite fabric of the invention may be produced by modifying known knife-over-roll methods to enable two or more different polymer compositions to be simultaneously applied to a substrate.

Due to the manufacturing variation inherent in knife-over-roll coating caused by the liquid application of the coating to the substrate and its mechanical removal, knife-over-roller coating is conventionally used to apply a coating of a single material across the width of a substrate.

However, it has been surprisingly found that when the region behind the knife, where the liquid coating is applied to the surface of the substrate, is sub-divided, multiple polymer coatings may be simultaneously applied to a single substrate without significant mixing of the different coatings, ie there is sufficient contact at the interface between the different coatings that the coatings bond together along the interface, but mixing of the compositions is limited such that the distinct physical and/or visual properties of the two regions are retained. The resulting polymeric surface forms a continuous polymer layer comprising adjoining first and second regions which extend longitudinally along a length of the fabric, the first and second regions being formed from first and second polymer compositions.

Thus, according to a further aspect of the invention there is provided a method of knife-over-roll coating for the manufacture of a waterproof composite fabric comprising a textile layer and a continuous polymer layer, said polymer layer comprising adjoining first and second regions that have different physical or visual properties, the first and second regions being in a side-by-side arrangement extending longitudinally along a length of the fabric, the first region being formed from a first polymer composition and the second region being formed from a second polymer composition, the method comprising simultaneously applying the first and second polymer compositions to a substrate, before the substrate is moved by the rotation of a support roller beneath a knife.

The polymer compositions are preferably dissolved in a solvent (or solvent system) or melted in order to be spread to the preferred weight (less than 220 gsm). Thus, in some embodiments the polymer compositions comprise one or more polymers, one or more solvents and optionally one or more additives. In some embodiments the polymer compositions are heated and applied as a melt.

It may be simpler and safer to avoid the use of heat in the manufacture of coated textiles, therefore the knife-over-roll methods of the present invention where the polymer compositions each comprise one or more polymers and one or more solvents may be advantageous compared to methods that apply the polymer compositions as hot melts and therefore require heat.

In some embodiments, the polymer compositions are not heated. In some embodiments the polymer compositions are not applied as hot melts.

However, using knife-over-roll coatings methods, the polymer compositions may be applied as hot melts using relatively low temperatures and pressures. The polymer compositions may be heated to a temperature between about 60-100° C., between about 65-90° C. or between about 70-80° C. In comparison, extrusion coating methods require significantly higher temperatures to achieve the viscosity required for extrusion, typically temperatures in the region of 200° C.

It will be appreciated that any aspects of the invention described in relation to one aspect of the invention may be incorporated into another aspect of the invention. Thus, any features described in relation to the composite fabric may, where appropriate, be incorporated into the method for its production.

The substrate forms the surface to which the polymer layer is applied, and may be any suitable substrate used in transfer-coating or direct-coating. In particular, the substrate may be a carrier (eg paper carrier) or a textile substrate. Typically, a textile substrate will be used during direct-coating, and a carrier will be used during transfer-coating.

Where the substrate is a textile substrate, it may be a woven, knitted or non-woven textile fabric, and may be formed of natural or synthetic fibres. The nature of the fabric structure and fibre content will influence the properties of the textile, for example affecting the tensile strength, flexibility, stretch etc. As different applications have different requirements, the particular textile used in the composite fabric may be selected based on the physical attributes that are desired in the finished product.

When a textile substrate is used, the textile substrate will typically form the textile layer of the composite fabric. Where a carrier is used, the polymer layer is subsequently transferred to a textile, which forms the textile layer of the composite fabric.

Typically, the area immediately preceding and abutting the knife is subdivided into a plurality of sub-sections, and with at least one sub-section containing a first polymer composition and an adjacent sub-section containing a second polymer composition.

The area immediately preceding and abutting the knife may be subdivided through the use of one or more dividers situated directly behind the knife. The one or more dividers may be formed of any suitable material, eg metal or plastic, and will typically be shaped such that they conform to the shape of the knife and the support roller, such that the polymer compositions cannot leak past the divider(s).

There may additionally be a backplate, located at a distance behind the knife, ie in the area preceding the knife, and contacting the support roller. The backplate helps to prevent loss of the polymer compositions. The one or more dividers may be located between the knife and the backplate, contacting the knife, backplate and support roller on three sides to form a secure vessel in which the polymer composition is retained.

The substrate may be on a roll or "bolt", such that it can be unrolled as it is supported by and moves continuously over the support roller.

The substrate is moved at a substantially constant speed by the rotation of the support roller, to ensure that the layer of polymer composition applied to the surface of the substrate is of consistent weight.

By "moved continuously" is meant that the substrate moves smoothly without stopping. It may, however, be necessary to pause the manufacturing method at intervals to replace the supply of the substrate, for example to replace a finished roll or bolt of the substrate.

It has been found that this method enables the formation of regions formed from different polymer compositions which do not separate in use, and wherein the continuous polymer layer is formed in a single application of the polymer compositions. The regions abut and are joined together, that is, the point at which the regions contact does not have a seam or ridge line, but the polymer compositions themselves are keyed together and do not separate once dried and/or cured. There may be a degree of merging or mingling of the polymer compositions at the point at which they join. This effect may be enhanced through the choice of polymer, for example, using the same type of polymer in each polymer composition (for example a polyurethane) may assist in effective joining of the two regions. Alternatively or in addition, use of the same solvent or solvent system may assist in effective joining of the two regions.

As previously described, where the method of the invention is used in transfer-coating, the polymer compositions are applied to a carrier. In order to transfer the layer of polymer composition to a textile layer, the textile is overlaid on top of the carrier/polymer composition laminate. Once the polymer compositions have bonded to the textile, the carrier is removed. This process may happen either before the polymer compositions have dried (wet lamination) or after they have been dried (dry lamination).

In preferred embodiments of the invention the composite fabric is used in the manufacture of a medical support surface cover, for example a waterproof mattress cover. For these purposes, it is important for the composite fabric to have good extension and recovery properties to facilitate pressure redistribution. This is best achieved by transfer coating of the polymer onto the textile substrate. Transfer coating provides a thin, flat coating of polymeric material on the textile, which does not significantly impede the mechanical properties of the textile and will stretch and conform with the fabric.

For a coated textile to have stretch properties, the textile itself must have a degree of extensibility. Thus, the use of a woven, non-woven or knitted fabric may be preferred. The fabric may be a woven fabric. The fabric may be a knitted fabric. Fabrics have a surface contour that is not completely flat. For example, the surface contour of a knitted fabric undulates over the interlocking loops of the yarn.

In transfer coating, the polymer layer is formed on a carrier that has flat surface (relative to the contoured surface of the fabric). Hence, the polymer coating is formed with a flat surface on the carrier and it maintains that flat surface to some extent when it is laminated onto the fabric layer. The polymeric layer may be dried on the carrier prior to application of the textile (dry lamination) or the process may be carried out while the polymer composition is still liquid (wet lamination). The polymer layer may conform to the contours of the fabric surface to a greater extent following wet lamination.

There is thus provided a method of knife-over-roll coating for making a waterproof composite fabric comprising a textile layer and a continuous polymer layer, the polymer layer comprising adjoining first and second regions that have different physical or visual properties, the first and second regions being in a side-by-side arrangement extending longitudinally along a length of the fabric, the first region being formed from a first polymer composition and the second region being formed from a second polymer composition, the method comprising:

a) simultaneously applying the first and second polymer compositions to a carrier to form a polymer composition layer, before the substrate is moved by a support roller beneath a knife;

b) applying a textile substrate to the surface of polymer composition layer produced in step a) such that the polymer compositions bond to the textile;

c) removing the carrier.

The first and second polymer compositions may each comprise one or more polymers and one or more solvents, or the first and second polymer compositions may each comprise one or more polymers and be melted. In some embodiments in which the first and second polymer compositions are melted, they do not contain solvent.

Direct-coating may also be used to manufacture stretchy polymer-coated fabrics of the invention for use, for example, in medical support surface covers. However, direct-coating results in greater penetration of the polymer composition into the fabric compared to transfer-coating, thus affecting the mechanical properties of the fabric to a greater extent. To the extent that the polymer penetrates the fabric, the substrate-facing surface of the of the polymer layer will follow the surface contours of the fabric. The top surface of the polymer layer will be flat and smooth, because it is levelled by the knife during manufacture.

Without wishing to be bound by theory, it is envisaged that extrusion coating methods would cause a polymer coating to penetrate the fabric to a greater extent than direct coating using knife-over-roller methods, given the high temperatures and pressures involved in extrusion.

BRIEF DESCRIPTION OF THE DRAWINGS

Embodiments of the invention are illustrated by means of the following figures.

DETAILED DESCRIPTION OF THE INVENTION

Figure 1:
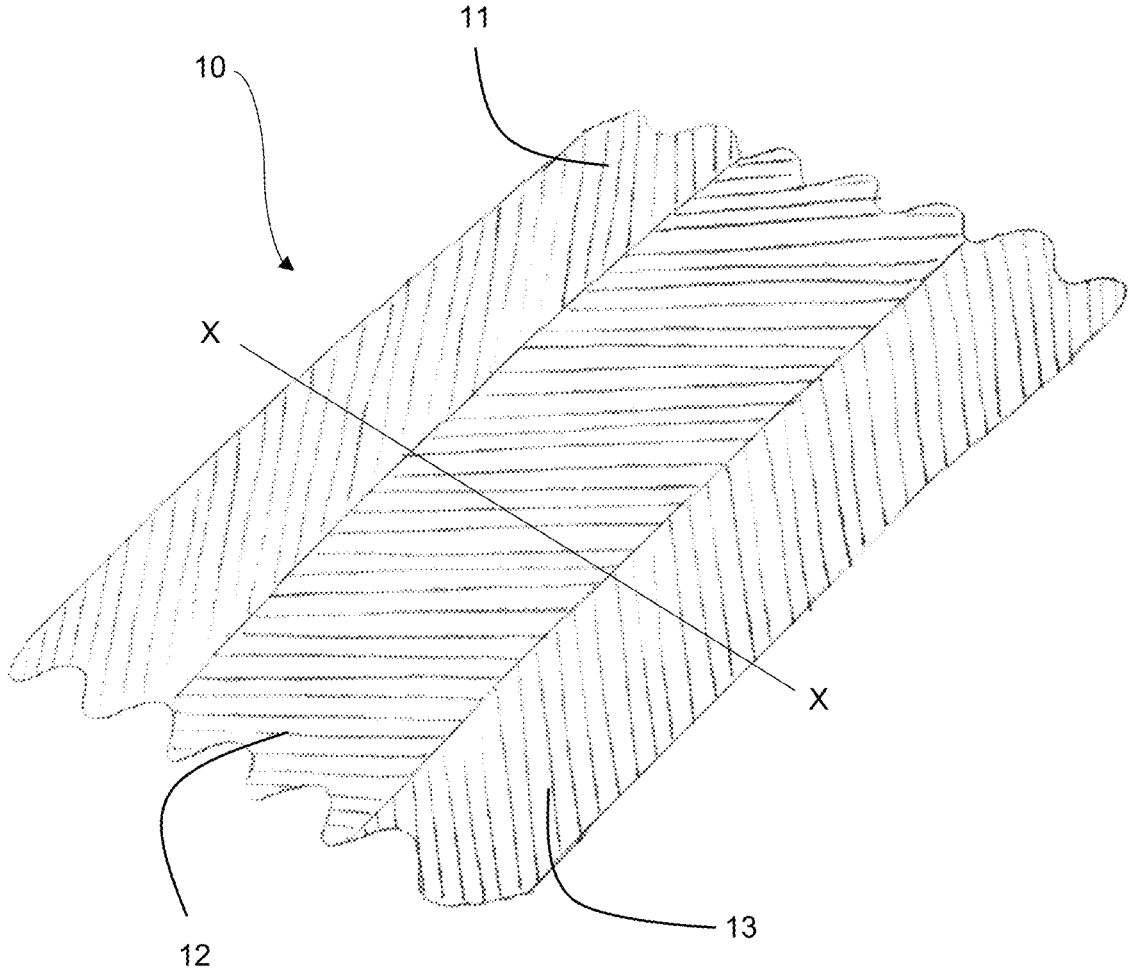
FIG. 1 is a perspective view of a composite fabric according to the invention.

FIG. 1 shows a composite fabric 10. The upper surface of the composite fabric 10 comprises three regions 11, 12, 13. Regions 11 and 13 are formed from the same polymer composition and therefore have the same physical and visual properties, while the intervening region 12 is formed from a second polymer composition and has different physical and/or visual properties.

The composite fabric 10 is formed as a continuous piece of fabric, with the regions 11, 12, 13 extending longitudinally, and parallel, along the length of the fabric. Adjacent regions 11, 12 and 12, 13 are adjoining, such that the regions abut and are joined to each other, with no break or gap in the continuous polymer layer between them.

Figure 2:
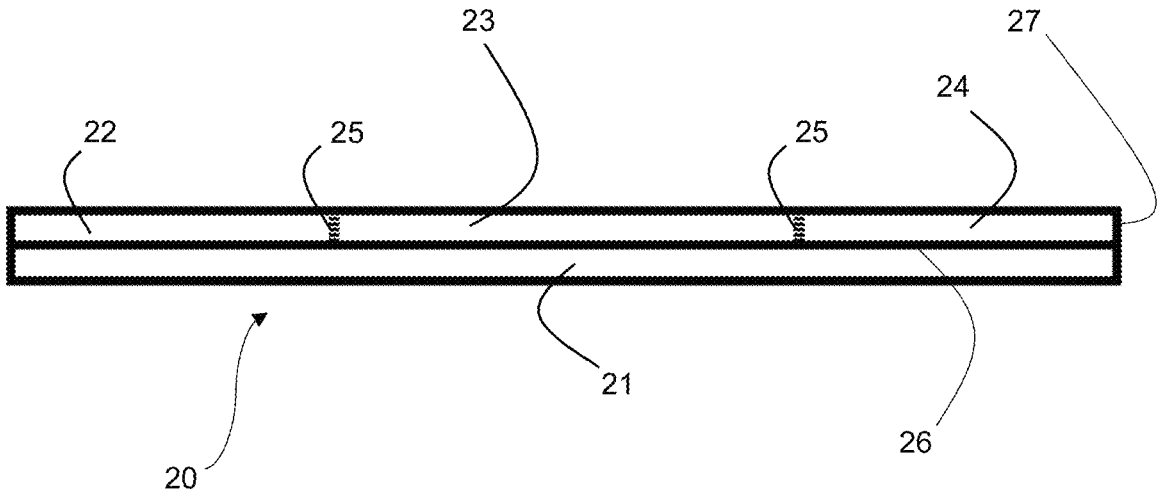
FIG. 2 is a schematic diagram showing a cross-section of one embodiment of a composite fabric of FIG. 1 along the line X-X.

FIG. 2 shows a schematic cross-sectional representation of an embodiment of the composite fabric depicted in FIG. 1. The composite fabric 20 shown in FIG. 2 comprises a textile layer 21, a polymer layer 27 and a layer of adhesive 26. The textile layer 21 forms the lower surface of the composite fabric 20, and is a knitted textile made from nylon. It will be appreciated that woven and non-woven textiles would also be suitable for use in the described composite fabric, made from nylon or other synthetic or natural fibres. The polymer layer 27 is formed of three regions 22, 23, 24. Regions 22 and 24 are formed from the same polyurethane polymer composition and therefore have the same physical and visual properties, while the intervening region 23 is formed from a second polyurethane polymer composition and has different physical and/or visual properties. The adjacent regions 22, 23 and 23, 24 are adjoining at 25. At the join 25 the polymer compositions, when forming the fabric, join to form a continuous polymer layer. At the join 25 there may be a clear distinction between the regions 22, 23 and 23, 24, such that there is no mixing of the polymer compositions. Alternatively, there may be a limited degree of merging of the polymer compositions at the join 25.

Between the polymer layer 27 and textile layer 21 there is a layer of polyurethane adhesive 26, ensuring secure adhesion between the textile layer 21 and polymer layer 27.

Figure 3:
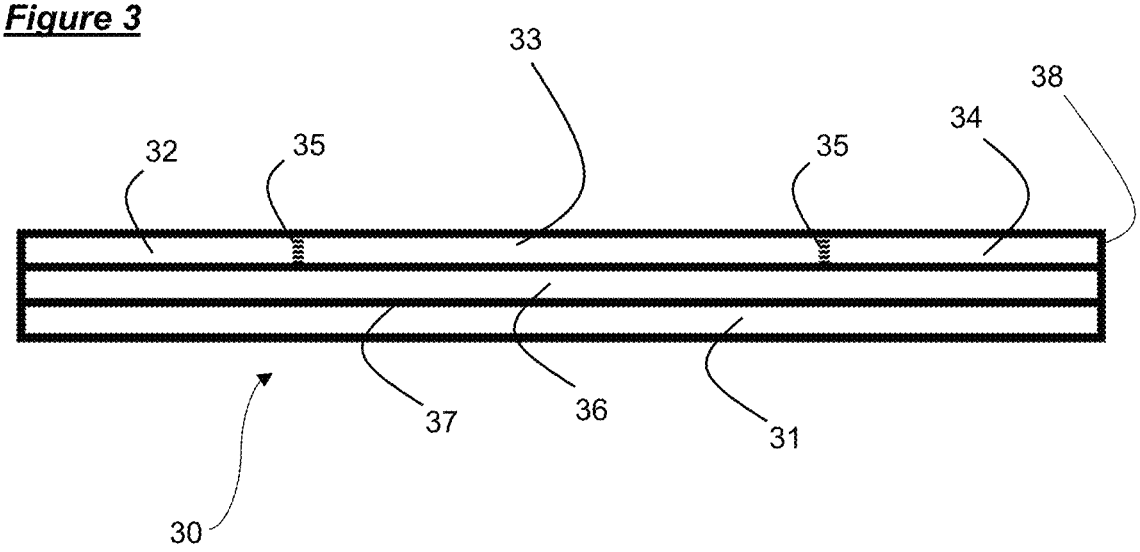
FIG. 3 is a schematic diagram showing a cross-section of an alternative embodiment of a composite fabric of FIG. 1 along the line X-X.

FIG. 3 shows a cross-sectional representation of an alternative embodiment of the composite fabric depicted in FIG. 1. The composite fabric 30 shown in FIG. 3 comprises a textile layer 31, an interlayer 36, a polymer layer 38 and a layer of adhesive 37. The textile layer 31 forms the lower surface of the composite fabric 30, and is a knitted textile. Directly above the textile layer 31 is a layer of polyurethane adhesive 37. On top of the layer of adhesive 37 is an interlayer 36 formed of polyurethane.

Above the interlayer 36 and forming the upper surface of the composite fabric 30, the polymer layer 38 is formed of three regions 32, 33, 34. Regions 32 and 34 are formed from the same polyurethane polymer composition and therefore have the same physical and visual properties, while the intervening region 33 is formed from a second polyurethane polymer composition and has different physical and/or visual properties. The adjacent regions 32, 33 and 33, 34 meet at join 35. At the join 35 the polymer compositions, when forming the fabric, join to form a continuous polymer layer. At the join 35 there may be a clear distinction between the regions 32, 33 and 33, 34, such that there is no mixing of the polymer compositions. Alternatively, there may be a limited degree of merging of the polymer compositions at the join 35.

Figure 4:
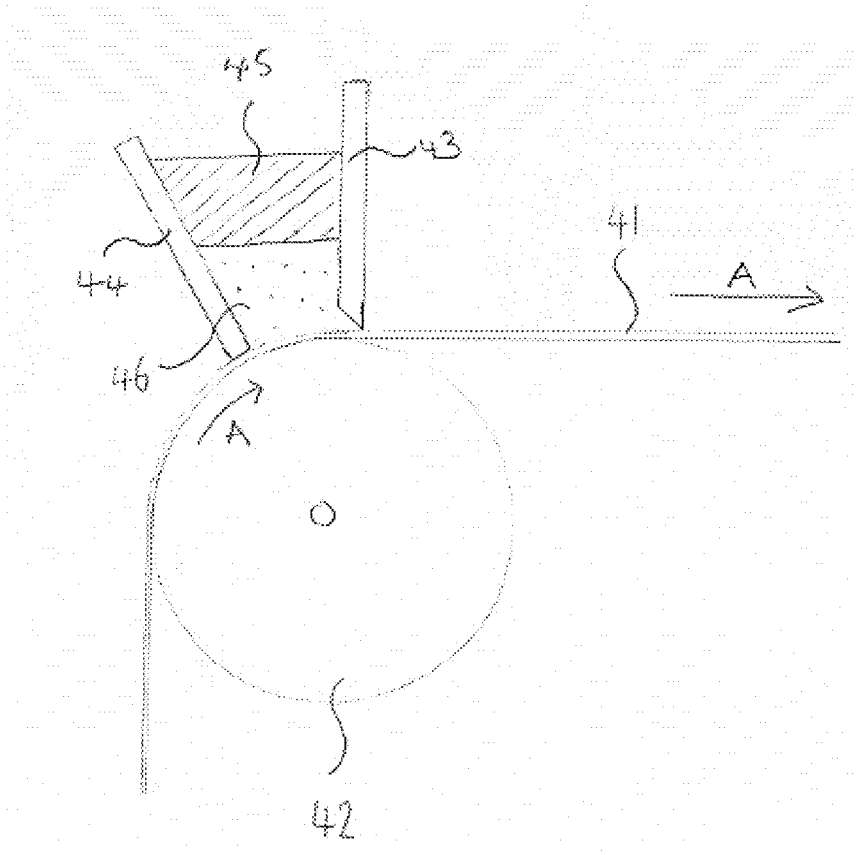
FIG. 4 shows a schematic diagram of the knife-over-roll coating method of the invention.
Figure 5:
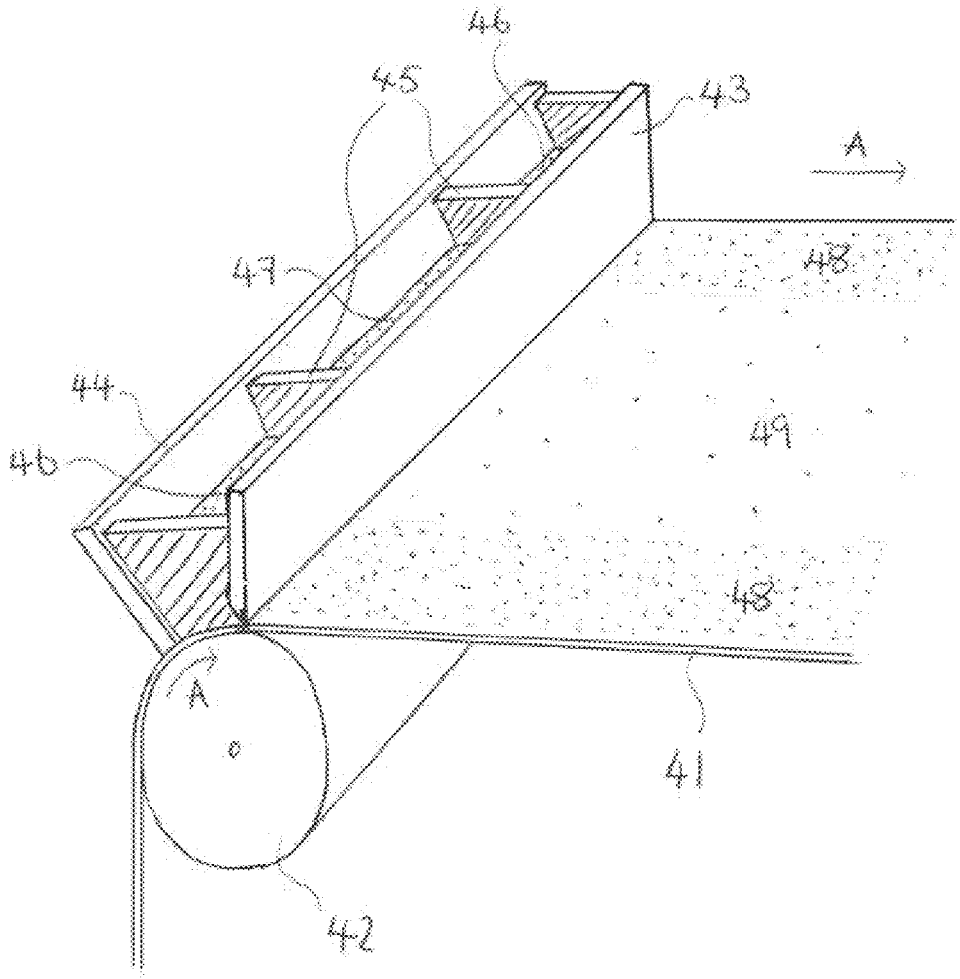
FIG. 5 shows a perspective view of the schematic diagram of FIG. 4.

FIGS. 4 and 5 show a schematic diagrams of the knife-over-roll coating method of the invention. A substrate 41 is moved in a continuous motion by the rotation of support roller 42 in the direction of arrow A. A knife 43 is suspended vertically above the support roller 42 with the gap between the knife blade 43 and the support roller 42 being proportional to the desired thickness of the coating on the substrate 41. A backplate 44 is located a distance behind the knife 43, and contacts the surface of the substrate 41. Dividers 45 separate the area defined by the backplate 44, knife 43 and support roller 42 into three sub-sections, each of which contain a polymer composition 46, 47, the polymer composition in the central sub-section being different to the polymer compositions in the adjacent sub-sections. The polymer composition 46, 47 contacts the area of the substrate above the support roller that is between the backplate and the knife. As the rotation of the support roller 42 moves the substrate 41, the un-coated surface of the substrate 41 comes into contact with the polymer composition 46, 47 in each sub-section simultaneously. Continuous rotation of the support roller 42 moves the substrate 41 under the knife 43, which only permits a thin layer of the polymer composition 46 contained in each sub-section to pass underneath, resulting in the substrate 41 being coated with polymer compositions 46, 47 in three regions 48, 49, the central region 49 differing from adjacent regions 48 in at least one physical or visual characteristic.

The invention claimed is:

1. A method of knife-over-roll coating for the manufacture of a waterproof composite fabric comprising a textile layer and a continuous polymer layer, said polymer layer comprising adjoining first and second regions that have different physical or visual properties, the first and second regions being in a side-by-side arrangement extending longitudinally along a length of the fabric, the first region being formed from a first polymer composition and the second region being formed from a second polymer composition, the method comprising simultaneously applying the first and second polymer compositions to the textile layer, and the textile layer and the applied first and second polymer compositions being moved by the rotation of a support roller beneath a knife, such that excess polymer composition is scraped off the textile layer by the knife, leaving a desired thickness of the adjoining first and second regions of the polymer layer, wherein one or more dividers are situated directly behind the knife, the one or more dividers subdividing the area immediately preceding the knife into a plurality of sub-sections, with at least one sub-section containing a first polymer composition and an adjacent sub-section containing a second polymer composition.

2. The method of claim 1, wherein the first and second polymer compositions each comprise one or more polymers and one or more solvents.

3. The method of claim 1, wherein the first and second polymer compositions are applied at a temperature between about 60-100° C.

4. The method of claim 1, further comprising a backplate located in the area preceding the knife, wherein the backplate, knife and support roller define three sides of a vessel, the vessel being divided by the dividers into the plurality of sub-sections of the area immediately preceding the knife.

5. A method of knife-over-roll coating for making a waterproof composite fabric comprising a textile layer and a continuous polymer layer, the polymer layer comprising adjoining first and second regions that have different physical or visual properties, the first and second regions being in a side-by-side arrangement extending longitudinally along a length of the fabric, the first region being formed from a first polymer composition and the second region being formed from a second polymer composition, the method comprising:

a) simultaneously applying the first and second polymer compositions to a carrier, and the carrier and the applied first and second polymer compositions being moved by a support roller beneath a knife, such that excess polymer composition is scraped off the carrier by the knife, leaving a desired thickness of the adjoining first and second regions of the polymer layer, wherein one or more dividers are situated directly behind the knife, the one or more dividers subdividing the area immediately preceding the knife into a plurality of sub-sections, with at least one sub-section containing a first polymer composition and an adjacent sub-section containing a second polymer composition;

b) applying a textile substrate to the surface of the polymer composition layer produced in step a), such that the polymer compositions bond to the textile; and c) removing the carrier.

6. The method of claim 5, wherein the first and second polymer compositions each comprise one or more polymers and one or more solvents.

7. The method of claim 5, wherein the first and second polymer compositions are applied at a temperature between about 60-100° C.

8. The method of claim 5, further comprising a backplate located in the area preceding the knife, wherein the backplate, knife and support roller define three sides of a vessel, the vessel being divided by the dividers into the plurality of sub-sections of the area immediately preceding the knife.

* * * * *